US006666321B2

(12) United States Patent
Spatafora

(10) Patent No.: US 6,666,321 B2
(45) Date of Patent: Dec. 23, 2003

(54) CONVEYING UNIT FOR TRANSFERRING A MASS OF CIGARETTES

(75) Inventor: Mario Spatafora, Bologna (IT)

(73) Assignee: G.D S.p.A., Bologna (IT)

( * ) Notice: Subject to any disclaimer, the term of this patent is extended or adjusted under 35 U.S.C. 154(b) by 7 days.

(21) Appl. No.: 10/139,386

(22) Filed: May 7, 2002

(65) Prior Publication Data

US 2002/0166751 A1 Nov. 14, 2002

(30) Foreign Application Priority Data

May 11, 2001 (IT) ..... BO2001A0286

(51) Int. Cl.[7] ..... B65C 1/00; B65C 37/00; B65C 47/12; B65C 47/26; B65C 43/08

(52) U.S. Cl. ..... 198/347.1; 198/454; 198/572

(58) Field of Search ..... 198/347.1, 347.2, 198/454, 572

(56) References Cited

U.S. PATENT DOCUMENTS

| | | | | |
|---|---|---|---|---|
| 3,985,252 A | | 10/1976 | Hinchcliffe et al. | |
| 4,339,025 A | * | 7/1982 | McCombie | 198/572 |
| 4,368,742 A | * | 1/1983 | Wahle et al. | 198/347.2 |
| 4,717,009 A | * | 1/1988 | Carter et al. | 198/347.1 |
| 4,795,019 A | * | 1/1989 | Spada et al. | 198/347.2 |

FOREIGN PATENT DOCUMENTS

| | | |
|---|---|---|
| DE | 2841266 | 4/1980 |
| EP | 1077035 | 2/2001 |
| GB | 2035777 | 6/1980 |
| GB | 2124174 | 2/1984 |
| GB | 2157252 | 10/1985 |
| GB | 2179614 | 3/1987 |

* cited by examiner

*Primary Examiner*—Gene O. Crawford
(74) *Attorney, Agent, or Firm*—Davidson Berquist Klima & Jackson, LLP

(57) ABSTRACT

A conveying unit for transferring a mass of cigarettes includes a feed channel equipped with a conveyor by which cigarettes are made to flow along a given path and in a given direction toward the mouth of a hopper that forms part of a user unit. One section of the feed channel presents a movable wall consisting of an articulated mechanism having two rigid restraints, one rectilinear and one arched, connected together pivotably by a hinge; the end of the arched restraint is connected to a fixed hinge, while the end of the rectilinear restraint is connected to a movable hinge rigidly associated with a guided slide device capable of movement along the direction of the advancing flow of cigarettes, in response to variations in the rate of flow along the channel. As the movable end is displaced, the movable wall shifts between two limit positions corresponding respectively to a maximum and a minimum capacity of the section of the feed channel occupied by the wall.

19 Claims, 3 Drawing Sheets

CONVEYING UNIT FOR TRANSFERRING A MASS OF CIGARETTES

BACKGROUND OF THE INVENTION

The present invention relates to a conveying unit for the transfer of cigarettes en masse, and more exactly to the conveying units used typically to link a cigarette maker with a cigarette packer.

Conventionally, in conveying units of the type in question, the means by which the cigarettes are supported and conveyed consist in bands or belts combining to create at least one channel, or in at least one channel element equipped with a conveyor by which the cigarettes are advanced. In both cases the cigarettes are disposed horizontally and en masse along the channel, and made thus to advance continuously in a direction transverse to their longitudinal axes. The channel originates from the cigarette maker and extends along a path composed generally of horizontal and vertical stretches and bends, and sometimes inclines, leading ultimately into a hopper from which the cigarettes are fed to the packer.

One condition necessary for the correct operation of the conveying unit, and therefore of the system as a whole, is that the quantity of cigarettes occupying the channel at any one time will be such as to exclude the risk of a break in continuity at the infeed of the packer, while ensuring also that the orderly arrangement of the cigarettes is not disrupted, especially along the bends and descent stretches of the conveyor.

Another condition necessary for correct operation is that there will be no pressures within the mass of cigarettes flowing along the channel that might occasion a jam in the channel and/or cause damage to the cigarettes.

The object of the present invention is to provide a conveying unit unaffected by the aforementioned drawbacks.

SUMMARY OF THE INVENTION

The stated object is realized in a conveying unit for transferring a mass of cigarettes, comprising at least one feed channel embodied at least in part as a conveyor by which the mass of cigarettes is advanced along a predetermined path and in a given direction toward the infeed stage of a user unit.

To advantage, the conveying unit according to the present invention is embodied with at least one movable wall defining at least one section of the channel and compassed between two ends of which one is fixed and the other movable.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
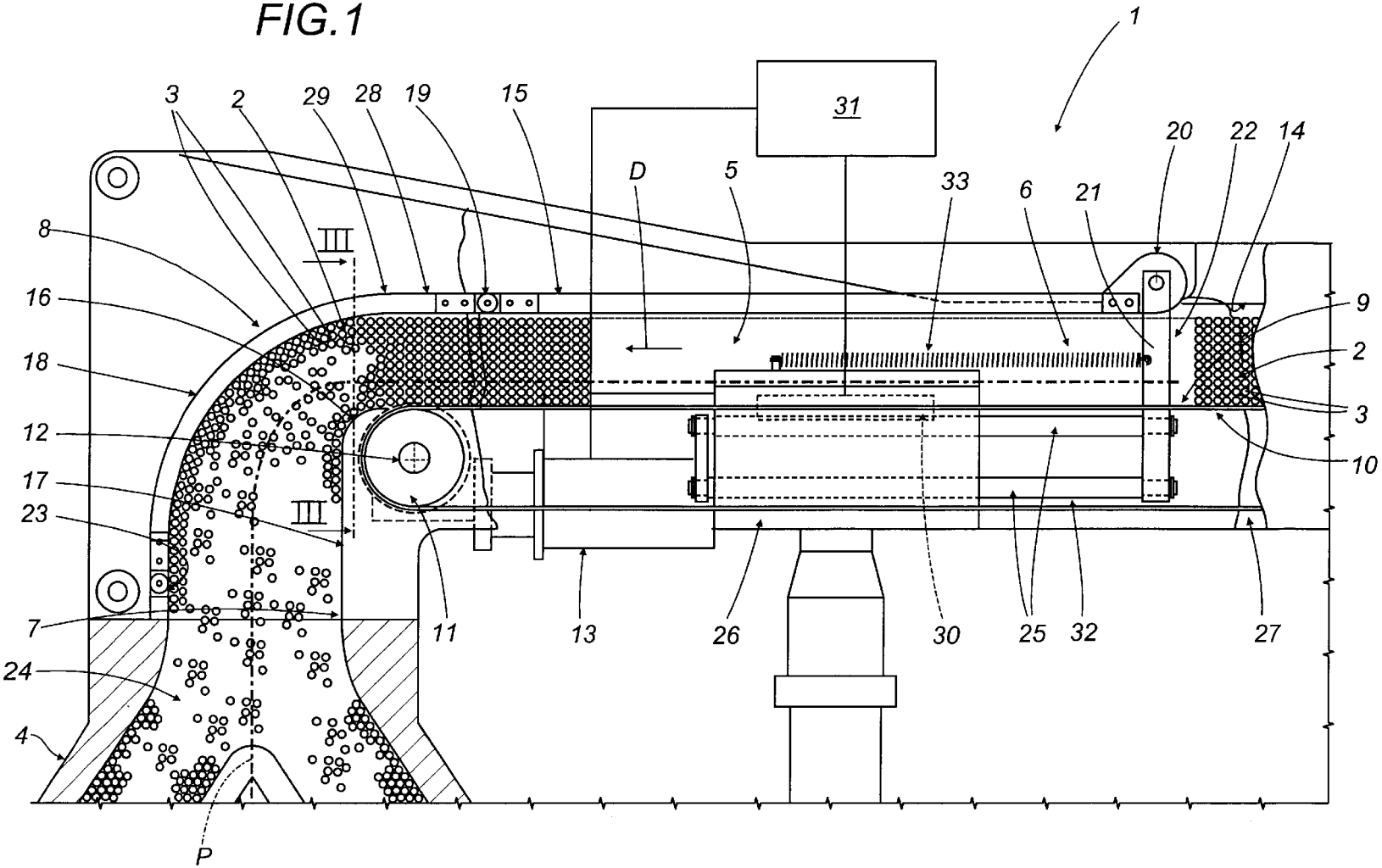
FIGS. 1 and 2 are two schematic side elevations of a conveying unit equipped with a movable wall embodied in accordance with the present invention, disposed respectively in two different operating conditions, illustrated with certain parts shown in section and others omitted for clarity.
Figure 2:
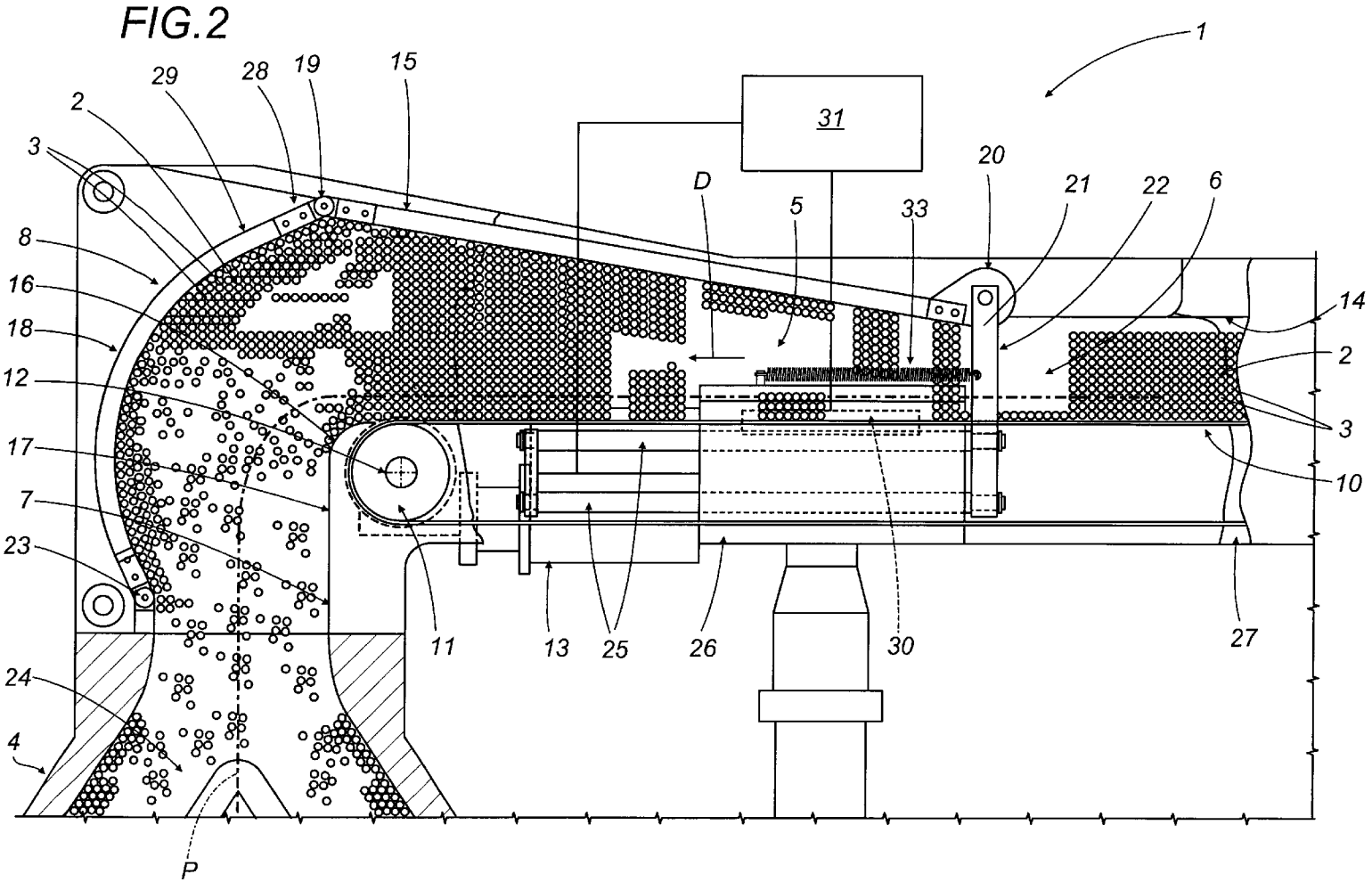

With reference to the drawings, FIGS. 1 and 2 show a conveying unit, denoted 1 in its entirety, by which a mass 2 of cigarettes 3 is transferred along a path P and in a direction D transverse to the longitudinal axes of the selfsame cigarettes, from a cigarette maker, not illustrated, to a user unit which in the particular example illustrated is represented by the infeed hopper 4 of a cigarette packer, likewise not illustrated.

It will be observed in FIGS. 1 and 2 that some cigarettes 3 of the mass 2 are omitted, purely in the interests of simplified graphic representation; the mass 2 in effect is essentially compact and homogeneous, and flows from the cigarette maker to the hopper 4 substantially without voids or gaps attributable to the absence of single cigarettes 3.

The unit 1 comprises a feed channel 5 presenting a substantially rectilinear and horizontal first section 6 originating from the cigarette maker, a substantially vertical second section 7 leading to the mouth of the hopper 4, and a curved section 8 interconnecting the aforementioned first and second sections 6 and 7. The first rectilinear section 6 is delimited at the bottom by the top branch 9 of a belt conveyor 10 looped around pulleys of which one only, denoted 11, is illustrated in the drawings, located near the mouth of the curved section 8 and mounted to a shaft 12 with a transversely disposed axis driven by a relative motor 13. The conveyor 10 serves to advance a continuous flow of cigarettes 3 along the path P and into the mouth of the curved section 8. The channel 5 is delimited uppermost by a fixed wall 14 of which only the final part can be seen in the drawings, and thereafter, considered in the conveying direction D along which the flow of cigarettes 3 is advanced, by a movable rectilinear restraint 15 coinciding with the end portion of the rectilinear horizontal first section 6. The curved section 8 and the successive vertical section 7 are delimited on the inside by respective fixed curved and vertical walls 16 and 17, and on the outside by a second movable restraint 18 of arched profile, associated pivotably at the upstream end by way of an intermediate hinge 19 with the free end of the first movable restraint 15, of which the remaining end directed toward the fixed wall 14 is pivotably associated with a movable hinge 20 connected to the top end of a bracket 21 mounted to a guided slide device 22 capable of movement parallel to the top branch 9 of the conveyor 10. Finally, the end of the arched second restraint 18 remote from that connected to the intermediate hinge 19 is anchored pivotably to a fixed hinge 23 located near to the connection between the end of the channel 5 and the mouth 24 of the hopper 4.

Figure 3:
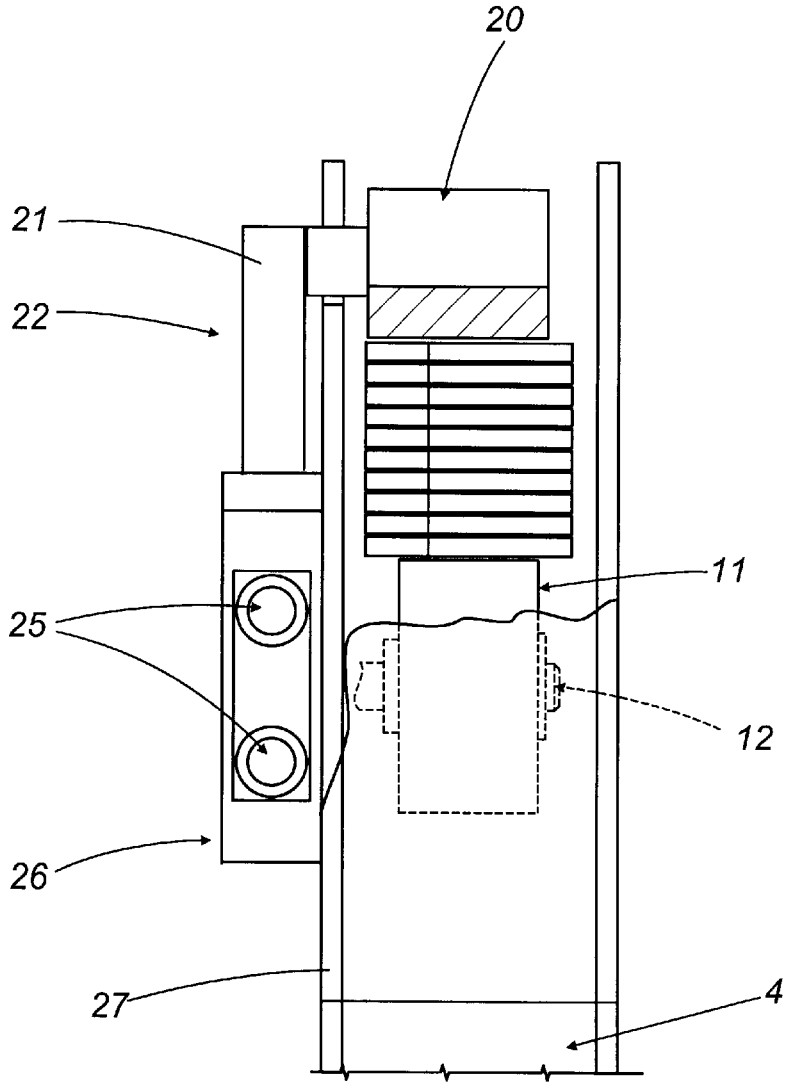
FIG. 3 is a schematic sectional view taken on III—III in FIG. 1.

As discernible from FIGS. 1, 2 and 3, the aforementioned guided slide device 22 comprises a pair of rods 25 extending parallel to the branch 9 of the conveyor 10 and occupying a common vertical plane, each fixed to the bracket 21 at one end. The rods 25 slide internally of a guide block 26 fixed to a lateral bulkhead 27 of the unit 1.

The two restraints 15 and 18 combine to create a movable wall 28 which in its turn constitutes an articulated mechanism 29 able to assume infinitely variable intermediate positions between a first limit position in which the first restraint 15 lies substantially parallel with the top branch 9 of the conveyor 10, and a second limit position in which the selfsame restraint 15 is inclined at a given angle as a result of rotating clockwise, as seen in FIGS. 1 and 2, about the aforementioned movable hinge 20. In the first of the two limit positions assumed by the rectilinear first restraint 15, the bracket 21 occupies a retracted position and the arched second restraint 18 is disposed with an initial rectilinear portion aligned on a terminal portion of the first restraint 15, as illustrated in FIG. 1, whilst in the second, the bracket 21 occupies a forward position and the arched second restraint 18 is rotated counterclockwise relative to the fixed hinge 23, as seen in FIGS. 1 and 2, to the point at which an angle of predetermined width, centered on the intermediate hinge 19, is compassed between the initial portion of the arched second restraint 18 and the terminal portion of the rectilinear first restraint 15. The two resulting limit positions of the movable wall 28 correspond respectively to configurations of minimum capacity and maximum capacity afforded by the relative part of the channel 5.

In particular, the unit 1 comprises a sensor 30 associated with the guided slide device 22, wired on the output side to a master controller 31 which is connected in turn to the motor 13. The sensor 30 is able at any given moment to detect the position of the rods 25 in relation to the guide block 26, hence the position assumed by the movable hinge 20, and thus to furnish the controller 31 with a signal that indicates the current position of the movable wall 28. On the basis of these same signals, the controller 31 will proceed to regulate the speed of the motor 13, hence also of the conveyor 10, and in this way control the rate at which the cigarettes 3 are advanced along the channel 5.

Regarding operation, it will be appreciated that the articulated mechanism 29 incorporating the two movable restraints 15 and 18, embodied in rigid material and presenting a smooth inner surface to the mass 2 of cigarettes 3, is structured in such a manner as to shift between the two limit positions without offering resistance and without applying any significant pressure to the flow of the mass 2 of cigarettes advancing along the channel 5.

The invention thus affords an extremely sensitive system that allows the articulated mechanism 29 to move toward the limit position corresponding to the maximum capacity of the channel 5 in the event of the mass 2 of cigarettes 3 swelling in volume along the section occupied by the movable wall 28, and then to return toward the position corresponding to the minimum capacity of the channel 5 when there is a reduction in volume of the mass 2 of cigarettes 3 along the selfsame section occupied by the wall 28. These movements will be generated swiftly, and in response to the slightest variations in flow.

To increase the sensitivity and speed of response afforded by the system, the unit 1 can be equipped with spring means of suitable design operating in conjunction with the aforementioned guided slide device and serving to assist the movement of the device toward the limit positions described above, in one direction and/or in the other.

To this end, for the sole purpose of clarifying the concept in question, FIGS. 1 and 2 indicate a spring 33 operating between the bracket 21 and a fixed point on the guide block 26, such as will exert a pulling force parallel to the flow path P and in the conveying direction D, favoring the movement of the wall 28 toward the position that coincides with maximum capacity of the channel 5. Clearly, the spring 33 could also be installed so as to operate between the bracket 21 and a fixed point on the side of the bracket opposite to that illustrated, in such a way as to exert a force parallel to the flow path P but in the direction opposite to the conveying direction D, favoring the return of the wall 28 to the position coinciding with the minimum capacity of the channel 5.

Moreover, during the movements of the articulated mechanism 29 described above, the slide device 22 functions also as a device 32 serving to support and stabilize the movable wall 28 in each of the positions assumed, so that the selfsame wall will not exert any significant pressures on the mass 2 of cigarettes 3.

What is claimed is:

1. A conveying unit for transferring a mass of cigarettes, comprising:

at least one feed channel embodied at least in part as a conveyor by which the mass of cigarettes is caused to flow along a predetermined path and in a predetermined direction toward an infeed stage of a user unit, at least one movable wall defining at least one section of the channel and compassed between two ends of which one is fixed and the other movable, the movable end of the wall being rigidly associated with a guided slide device movable in response to variations in the rate of the flow.

2. A unit as in claim 1, wherein the fixed end of the wall is connected to a fixed hinge and the movable end is connected to a hinge capable of movement in the direction of the advancing flow.

3. A unit as in claim 2, wherein the movable wall comprises an articulated mechanism including at least two rigid restraints interconnected pivotably by an intermediate hinge.

4. A unit as in claim 3, wherein one restraint is substantially rectilinear and connected by one end to the guided slide device, and the restraint is arched and connected by one end to the fixed hinge.

5. A unit as in claim 4, wherein the movable wall is capable of movement, accompanying the displacement of the movable end, between two limit positions corresponding respectively to a maximum capacity and a minimum capacity of a section of the channel occupied by the selfsame wall.

6. A unit as in claim 5, comprising sensor means able to generate signals indicating the position of the movable wall, and means by which to advance the mass of cigarettes.

7. A unit as in claim 6, wherein the sensor means are interlocked to the guided slide device.

8. A unit as in claim 2, comprising spring means associated with the guided slide device and serving to invest the guided slide device with at least one of a pushing and a pulling force parallel to the flow path in at least one of the direction of the flow and an opposite direction.

9. A unit as in claim 2, wherein the guided slide device is capable of movement in the direction of the advancing flow, parallel with the channel.

10. A unit as in claim 9, wherein the guided slide device comprises means by which to support and stabilize the movable wall.

11. A unit as in claim 1, wherein the guided slide device is capable of movement in the direction of the advancing flow, parallel with the channel.

12. A unit as in claim 11, comprising spring means associated with the guided slide device and serving to invest the guided slide device with at least one of a pushing and a pulling force parallel to the flow path in at least one of the direction of the flow and an opposite direction.

13. A unit as in claim 11, wherein the guided slide device comprises means by which to support and stabilize the movable wall.

14. A unit as in claim 13, wherein the guided slide device comprises at least one rod extending parallel to the flow path, connected by one end to the movable end of the movable wall and slidable along a fixed guide block.

15. A unit as in claim 11, wherein the movable wall comprises an articulated mechanism including at least two rigid restraints interconnected pivotably by an intermediate hinge.

16. A unit as in claim 15, wherein one restraint is substantially rectilinear and connected by one end to the guided slide device, and the restraint is arched and connected by one end to the fixed hinge.

17. A unit as in claim 16, wherein the movable wall is capable of movement, accompanying the displacement of the movable end, between two limit positions corresponding respectively to a maximum capacity and a minimum capacity of a section of the channel occupied by the selfsame wall.

18. A unit as in claim 17, comprising sensor means able to generate signals indicating the position of the movable wall, and means by which to advance the mass of cigarettes.

19. A unit as in claim 18, wherein the sensor means are interlocked to the guided slide device.

* * * * *